US010543416B1

(12) United States Patent
Moody, Jr. et al.

(10) Patent No.: US 10,543,416 B1
(45) Date of Patent: Jan. 28, 2020

(54) PROTECTIVE TRAVEL CASE FOR EQUIPMENT

(71) Applicant: CLUB CAGE, LLC, Danbury, CT (US)

(72) Inventors: Joseph T. Moody, Jr., Danbury, CT (US); Joseph Biraglia, Danbury, CT (US)

(73) Assignee: CLUB CAGE, LLC, Danbury, CT (US)

( * ) Notice: Subject to any disclaimer, the term of this patent is extended or adjusted under 35 U.S.C. 154(b) by 0 days.

(21) Appl. No.: 16/148,167

(22) Filed: Oct. 1, 2018

(51) Int. Cl.

| | |
|---|---|
| ***A63B 55/00*** | (2015.01) |
| ***A63B 71/00*** | (2006.01) |
| *A63B 102/32* | (2015.01) |
| *A63B 55/40* | (2015.01) |

(52) U.S. Cl.
CPC ..... *A63B 71/0036* (2013.01); *A63B 55/40* (2015.10); *A63B 2102/32* (2015.10)

(58) Field of Classification Search
CPC ... A63B 55/404; A63B 55/406; A63B 55/408; A63B 71/0036; A63B 2102/32; A63B 55/00
USPC ..... 206/315.3, 315.4, 315.8, 315.2; 211/70.2; 248/96
See application file for complete search history.

(56) References Cited

U.S. PATENT DOCUMENTS

| | | | | |
|---|---|---|---|---|
| 858,488 A | | 7/1907 | Tynes | |
| 1,155,475 A | | 10/1915 | Fay | |
| 1,206,618 A | | 11/1916 | Thrasher et al. | |
| 1,644,592 A | | 10/1927 | Howland | |
| 1,918,447 A | | 7/1933 | Blatz | |
| 2,070,254 A | * | 2/1937 | Burgner | A63B 55/00 211/70.2 |
| 2,435,479 A | * | 2/1948 | Thommen | A63B 55/00 206/315.8 |
| 2,653,826 A | | 9/1953 | Lu | |
| 2,752,973 A | | 7/1956 | Stamp | |
| 2,879,819 A | | 3/1959 | Turnbull | |
| 4,078,594 A | | 3/1978 | Oeckl | |
| 4,512,465 A | | 4/1985 | Jobe | |
| 4,522,300 A | | 6/1985 | Hamblet | |
| 4,635,793 A | | 1/1987 | Kim | |
| 4,788,996 A | | 12/1988 | Forshee | |

(Continued)

FOREIGN PATENT DOCUMENTS

| | | |
|---|---|---|
| WO | 2017161209 | 9/2017 |

*Primary Examiner* — Sue A Weaver
(74) *Attorney, Agent, or Firm* — Ware, Fressola, Maguire & Barber LLP

(57) ABSTRACT

An apparatus is provided for enclosing and protecting an article, such as a golf bag with golf clubs. The apparatus comprises a central spine and a plurality of frame members connected to the central spine, including at least one pair of frame members comprising a first frame member comprising a first locking member, and arranged on the central spine in a first orientation, and a second frame member comprising a second locking member, and arranged on the central spine in a second orientation. The first locking member of the first frame member is configured to be attached to the second frame member and the second locking member of the second frame member is configured to be attached to the first frame member, such that the first frame member is configured to engage the second frame member around the article.

20 Claims, 9 Drawing Sheets

(56) References Cited

U.S. PATENT DOCUMENTS 4,858,763 A * 8/1989 Scott ..... B65D 85/42 206/419
4,865,192 A 9/1989 Williams
4,905,827 A 3/1990 Kim
4,915,221 A 4/1990 Spangler
5,209,280 A 5/1993 Gevas
5,244,086 A 9/1993 Welch
5,437,320 A 8/1995 Sung
5,620,034 A * 4/1997 Flis ..... A63B 55/406 150/159
5,699,906 A 12/1997 Lombardo et al.
5,738,208 A 4/1998 Roubal
5,860,519 A 1/1999 Meyer et al.
5,921,387 A 7/1999 Arzoomanian et al.
5,941,383 A 8/1999 Cheng
6,029,813 A 2/2000 Smolenski
6,149,041 A * 11/2000 Perino ..... A45F 3/04 224/645
6,202,840 B1 3/2001 Chang
6,217,042 B1 4/2001 Kurtz et al.
6,273,251 B1 8/2001 Rust
6,298,987 B1 10/2001 Clark
6,557,702 B1 5/2003 Sanderson et al.
6,595,356 B1 7/2003 Homoly
6,612,412 B2 9/2003 Sanderson et al.
9,079,076 B2 * 7/2015 Weinmeier ..... A63B 55/00
9,114,759 B1 * 8/2015 Hudson ..... B60R 9/08
10,004,961 B2 6/2018 Pittman
2003/0168362 A1 * 9/2003 Yoshida ..... A45F 3/08 206/315.7
2004/0182726 A1 * 9/2004 Wang ..... A45C 7/0068 206/315.3
2004/0232016 A1 11/2004 Dietrich
2006/0185999 A1 8/2006 Keays
2008/0035691 A1 * 2/2008 Losos ..... A63B 55/00 224/429
2009/0308768 A1 12/2009 Quartarone
2010/0147714 A1 6/2010 Andochick
2010/0237576 A1 9/2010 Maccario

* cited by examiner

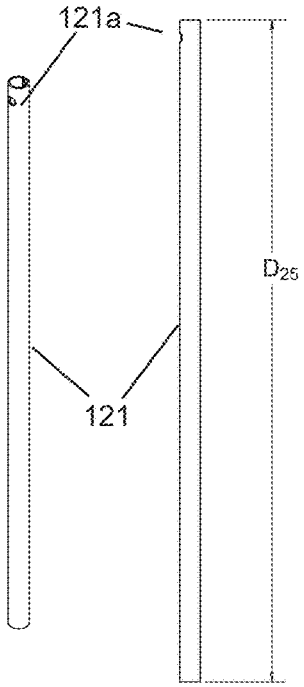
FIG. 8A
FIG. 8B
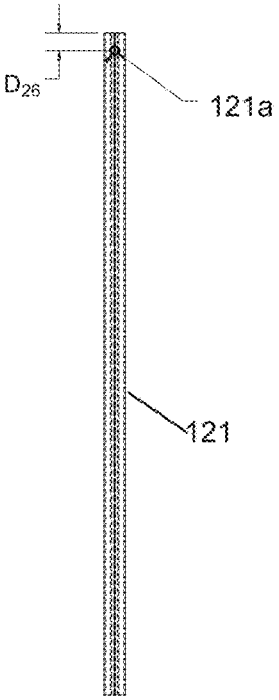
FIG. 8C
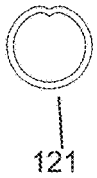
FIG. 8D
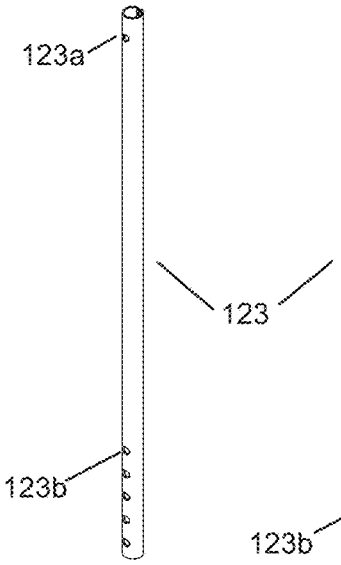
FIG. 9A
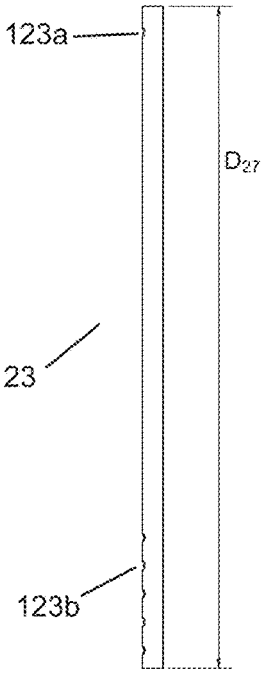
FIG. 9B
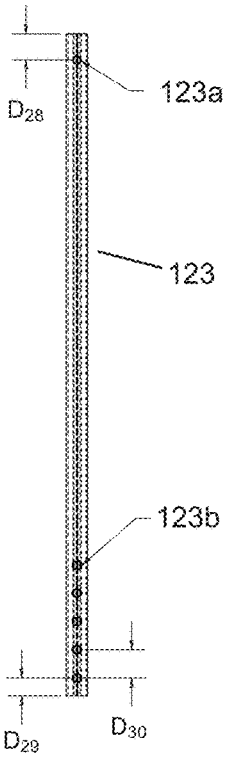
FIG. 9C
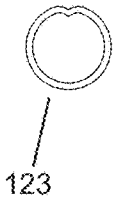
FIG. 9D

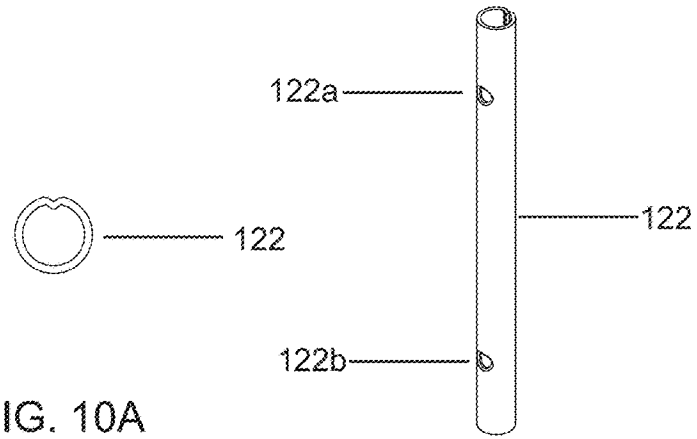
FIG. 10B
FIG. 10A
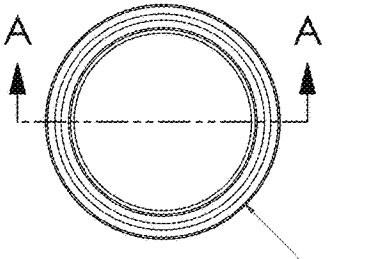
FIG. 11A
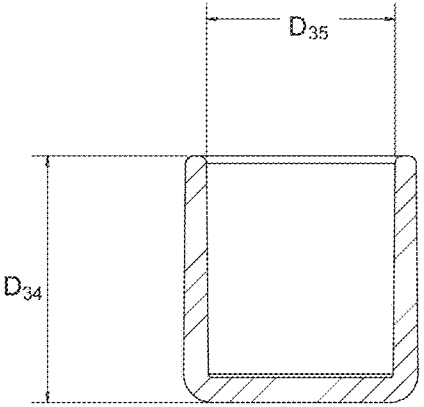
FIG. 11B
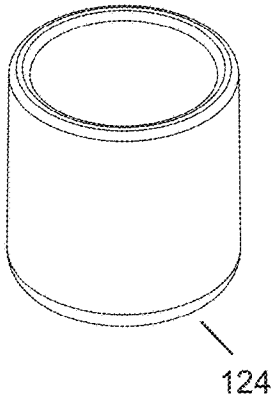
FIG.11C
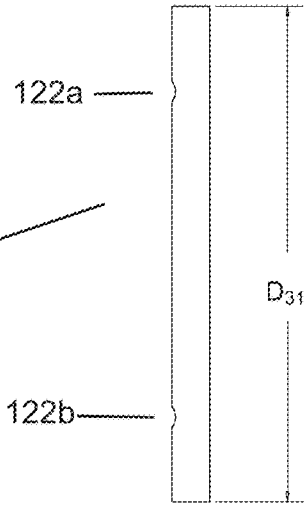
FIG. 10D
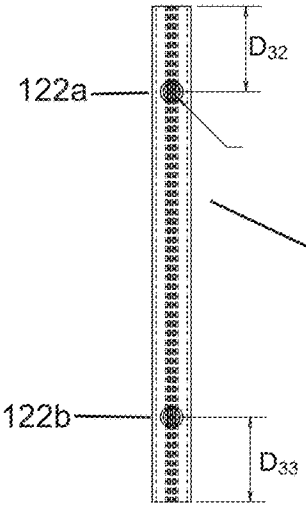
FIG. 10C

PROTECTIVE TRAVEL CASE FOR EQUIPMENT

FIELD OF THE INVENTION

The present invention relates to a protective travel case or frame for sports equipment, such as golf clubs, to protect the equipment from damage during travel.

BACKGROUND OF THE INVENTION

There are several difficulties associated with traveling with golf clubs and other types of sporting equipment, particularly when traveling by airplane. Given the size of a golf bag carrying golf clubs, a golf bag is generally checked as baggage at the airport and is not in the owner's possession during much of travel. A large duffel bag or other soft bag can be used to carry and store the golf bag as luggage during travel. However, such bags are exposed to strikes or blows during transport, such as, for example, if another item of luggage falls on top of the golf bag in the airport or in the baggage compartment of the plane. This can cause damage to the golf clubs in the golf bag, which have narrow shafts that can be prone to bending or breaking if a force is applied to the shaft. In addition to the inconvenience and the potential expense for replacing a broken golf club, if a golf club is broken or bent during air travel to a destination where the golf clubs are to be used, it may not be possible to replace or repair the club at the destination.

In view of these problems, rigid carrying cases are available for golf clubs, which are large enough to fit a golf bag including clubs and sufficiently solid and durable so as to protect the clubs from damage, such as if the carrying case is struck by another piece of luggage. However, these carrying cases are quite large and bulky, meaning that for many consumers, the carrying case cannot fit in their cars to transport the case and golf clubs, and the case is inconvenient to travel with.

There is therefore a need in the art for a device that can allow a traveler to adequately protect golf clubs or other equipment from damage during travel while avoiding the need to transport an excessively large or unwieldy case.

SUMMARY OF THE INVENTION

The present invention addresses the shortcomings of the art by providing a protective frame or case for enclosing and protecting sporting equipment, such as a golf bag with golf clubs. The protective frame or case comprises a plurality of frame members arranged along a central spine. The frame members are arranged on the central spine such that one set of frame members is arranged opposite another set of frame members to define an open case or frame into which the golf bag can be inserted. The opposing frame members can then be closed around the golf bag and locked together to provide a structure that protects the golf bag and golf clubs from damage, including along the length of the golf bag and clubs to prevent the shafts of the golf clubs from being bent or broken. Each of the frame members are preferably configured with the same structure, so that the protective case or frame can be easily assembled, as the frame members do not need to be assembled in a particular order. The frame members can be easily connected to and removed from the central spine to provide an easy assembly and disassembly process, so that the protective frame or case does not need to be stored or transported at its full size when it is not in use.

In accordance with a first aspect of the invention, an apparatus is provided for enclosing and protecting an article. The apparatus comprises a central spine and a plurality of frame members connected to the central spine, the plurality of frame members comprising at least one pair of frame members comprising a first frame member comprising a first locking member, and arranged on the central spine in a first orientation; and a second frame member comprising a second locking member, and arranged on the central spine in a second orientation. The first locking member of the first frame member is configured to be attached to the second frame member and the second locking member of the second frame member is configured to be attached to the first frame member, such that the first frame member is configured to engage the second frame member around the article.

In accordance with an embodiment of the apparatus of the first aspect of the invention, each of the plurality of frame members comprises: a frame body section, a frame arm extending from a first side of the frame body section, and at least one spine receiving member arranged on a second side of the frame body section opposite the first side and configured to attach the frame member to the central spine. The frame body section of each of the plurality of frame members may further comprise one or more bars and a plurality of open spaces formed between the one or more bars. In one embodiment of the apparatus, the first locking member comprises a strap having a first end with corresponding hook-and-loop fasteners on opposing sides of the strap to engage the first end of the strap to one of the one or more bars of the first frame member and a second end configured to pass through an opening in the frame arm section of the first frame member and comprising corresponding hook-and-loop fasteners on opposing sides of the strap to engage the second end of the strap to one of the one or more bars of the second frame member, and the second locking member comprises a strap having a first end with corresponding hook-and-loop fasteners on opposing sides of the strap to engage the first end of the strap to one of the one or more bars of the second frame member and a second end configured to pass through an opening in the frame arm section of the second frame member and comprising corresponding hook-and-loop fasteners on opposing sides of the strap to engage the second end of the strap to one of the one or more bars of the first frame member.

In accordance with an embodiment of the apparatus of the first aspect of the invention, which may encompass one or more of the above referenced embodiments of the apparatus, the plurality of frame members comprises at least two pairs of frame members, including a first pair of frame members comprising the first frame member comprising the first locking member, and the second frame member comprising the second locking member; and a second pair of frame members arranged on the central spine adjacent to the first pair of frame members, comprising a third frame member arranged on the central spine in the first orientation and comprising a third locking member, and a fourth frame member arranged on the central spine in the second orientation comprising a fourth locking member, wherein the third locking member of the third frame member is configured to be attached to the fourth frame member and the fourth locking member of the fourth frame member is configured to be attached to the third frame member, such that the third frame member is configured to engage the fourth frame member around the article. In a further embodiment of the apparatus, the apparatus further comprises a third pair of frame members arranged on the central spine adjacent to the second pair of frame members, comprising a fifth frame member arranged on the central spine in the first orientation and comprising a fifth locking member, and a sixth frame member arranged on the central spine in the second orientation comprising a sixth locking member, wherein the fifth locking member of the fifth frame member is configured to be attached to the sixth frame member and the sixth locking member of the sixth frame member is configured to be attached to the fifth frame member, such that the fifth frame member is configured to engage the sixth frame member around the article.

In accordance with an embodiment of the apparatus of the first aspect of the invention, which may encompass any one or more of the above referenced embodiments of the apparatus, each of the plurality of frame members are structurally and dimensionally the same.

In accordance with a further embodiment of the apparatus of the first aspect of the invention, which may encompass any one or more of the above referenced embodiments of the apparatus, the central spine comprises a plurality of spine members, including a first spine member and a second spine member configured to be connected to the first spine member. The central spine may further comprise an intermediate spine member configured to connect the first spine member to the second spine member. The central spine may also comprise an adjustable length. The at least one spine receiving member of the frame members may comprise at least one hollow tube configured to receive the central spine to attach the frame member to the central spine.

In accordance with a further embodiment of the apparatus of the first aspect of the invention, which may encompass any one or more of the above referenced embodiments of the apparatus, the apparatus further comprises a cover connected to a first end of the central spine configured to prevent the article from sliding out an open end of an enclosure formed by the plurality of frame members and configured to prevent the plurality of frame members from sliding off of the first end of the central spine. The apparatus may also comprise a cap connected to a second end of the central spine opposite the first end and configured to prevent the plurality of frame members from sliding off of the second end of the central spine.

In accordance with a further embodiment of the apparatus of the first aspect of the invention, the article is a golf bag comprising golf clubs.

According to a second aspect of the invention, a kit for an apparatus for enclosing and protecting an article is provided, the kit comprising: a central spine; a plurality of frame members, each frame member comprising: a frame body section, a frame arm extending from a first side of the frame body section, and at least one spine receiving member arranged on a second side of the frame body section opposite the first side and configured to removably attach the frame member to the central spine configured to be connected to the central spine, and a plurality of locking members, including a locking member for each of the plurality of frame members, configured to secure one of the plurality of frame members to another of the plurality of frame members when arranged on the central spine.

In accordance with a further embodiment of the kit of the second aspect of the invention, the frame body section of each of the plurality of frame members further comprises one or more bars and a plurality of open spaces formed between the one or more bars. Each of the plurality of locking members may further comprise a strap having a first end with corresponding hook-and-loop fasteners on opposing sides of the strap to engage the first end of the strap to one of the one or more bars of a first frame member and a second end configured to pass through an opening in the frame arm section of the first frame member and comprising corresponding hook-and-loop fasteners on opposing sides of the strap to engage the second end of the strap to one of the one or more bars of a second frame member. The central spine may further comprise a plurality of spine members, including a first spine member and a second spine member configured to be connected to the first spine member, and may comprise an intermediate spine member configured to connect the first spine member to the second spine member. The kit may also comprise a cover configured to be connected to a first end of the central spine; and a cap configured to be connected to a second end of the central spine opposite the first end and configured to prevent the plurality of frame members from sliding off of the second end of the central spine.

BRIEF DESCRIPTION OF THE DRAWINGS

FIGS. 8A-8D show various views of the lower spine member of the apparatus according to an embodiment of the present invention;

FIGS. 9A-9D show various views of the upper spine member of the apparatus according to an embodiment of the present invention;

FIGS. 10A-10D show various views of the intermediate spine member of the apparatus according to an embodiment of the present invention; and FIGS. 11A-11C show various views of the spine cap of the apparatus according to an embodiment of the present invention.

DETAILED DESCRIPTION OF THE INVENTION

Figure 1A:
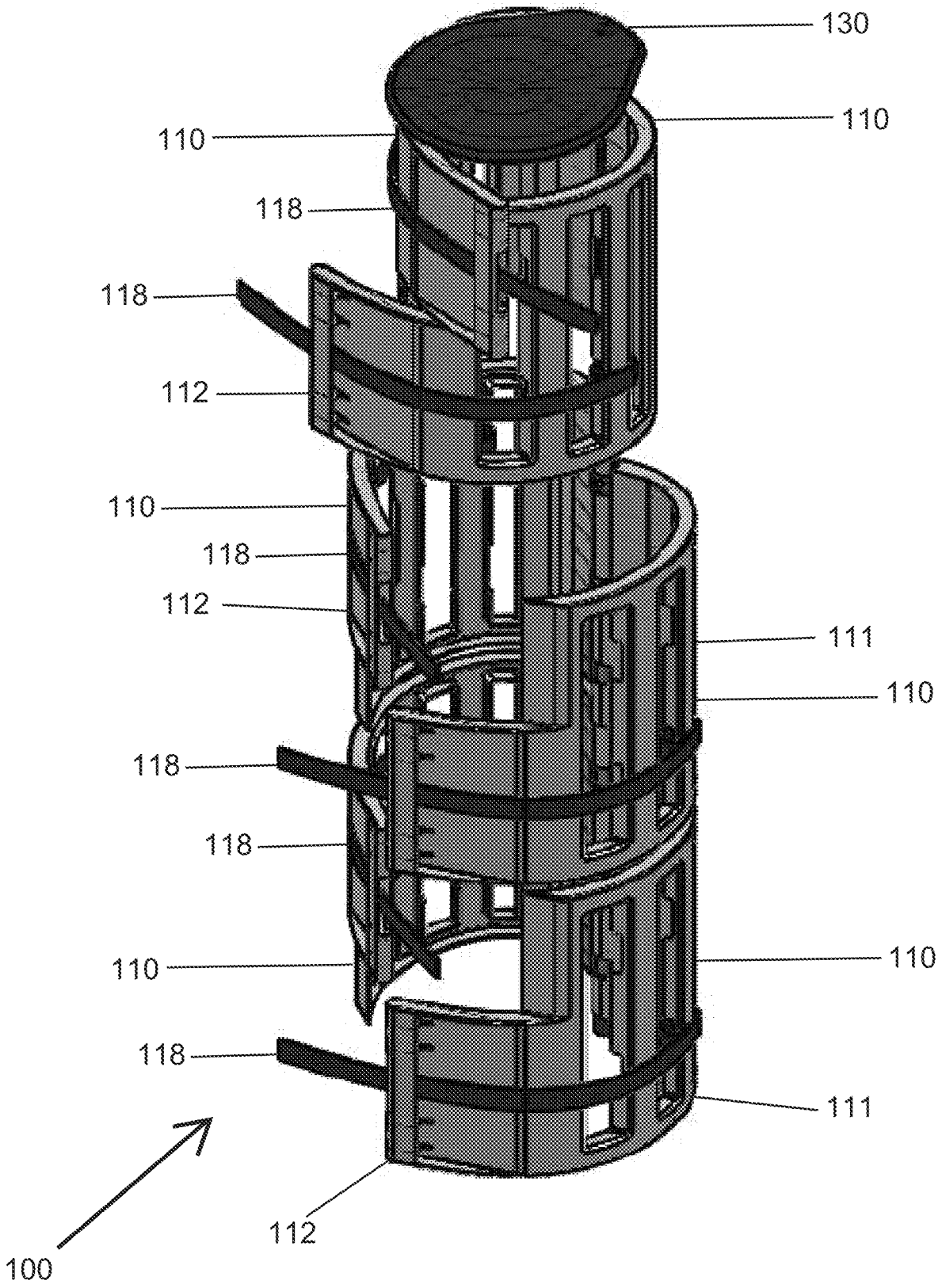
FIG. 1A shows a first view of an apparatus according to an embodiment of the present invention.
Figure 1B:
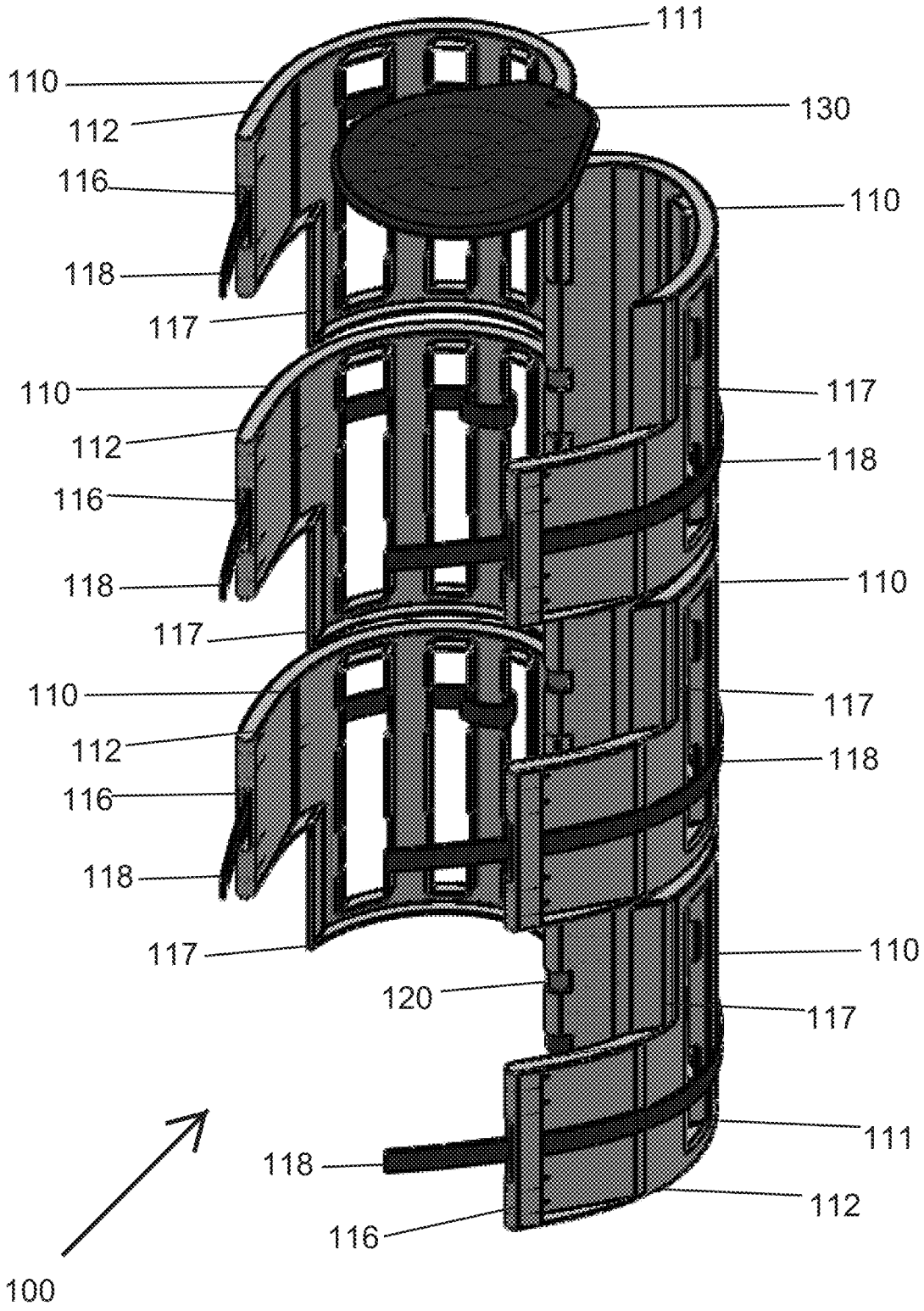
FIG. 1B shows a second view of the apparatus according to an embodiment of the present invention.
Figure 2A:
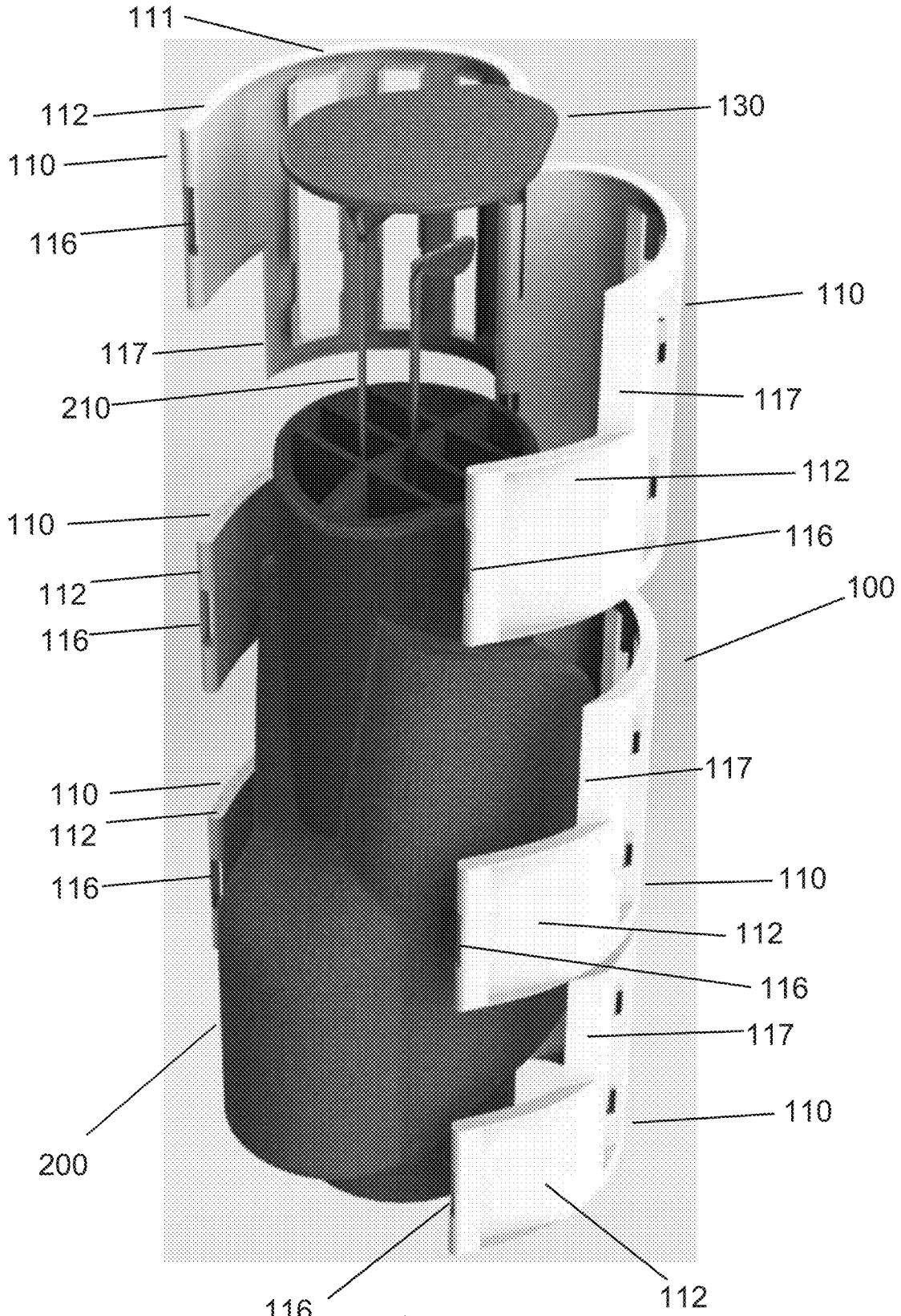
FIG. 2A shows a first view of an apparatus used in combination with a golf bag according to an embodiment of the present invention.
Figure 2B:
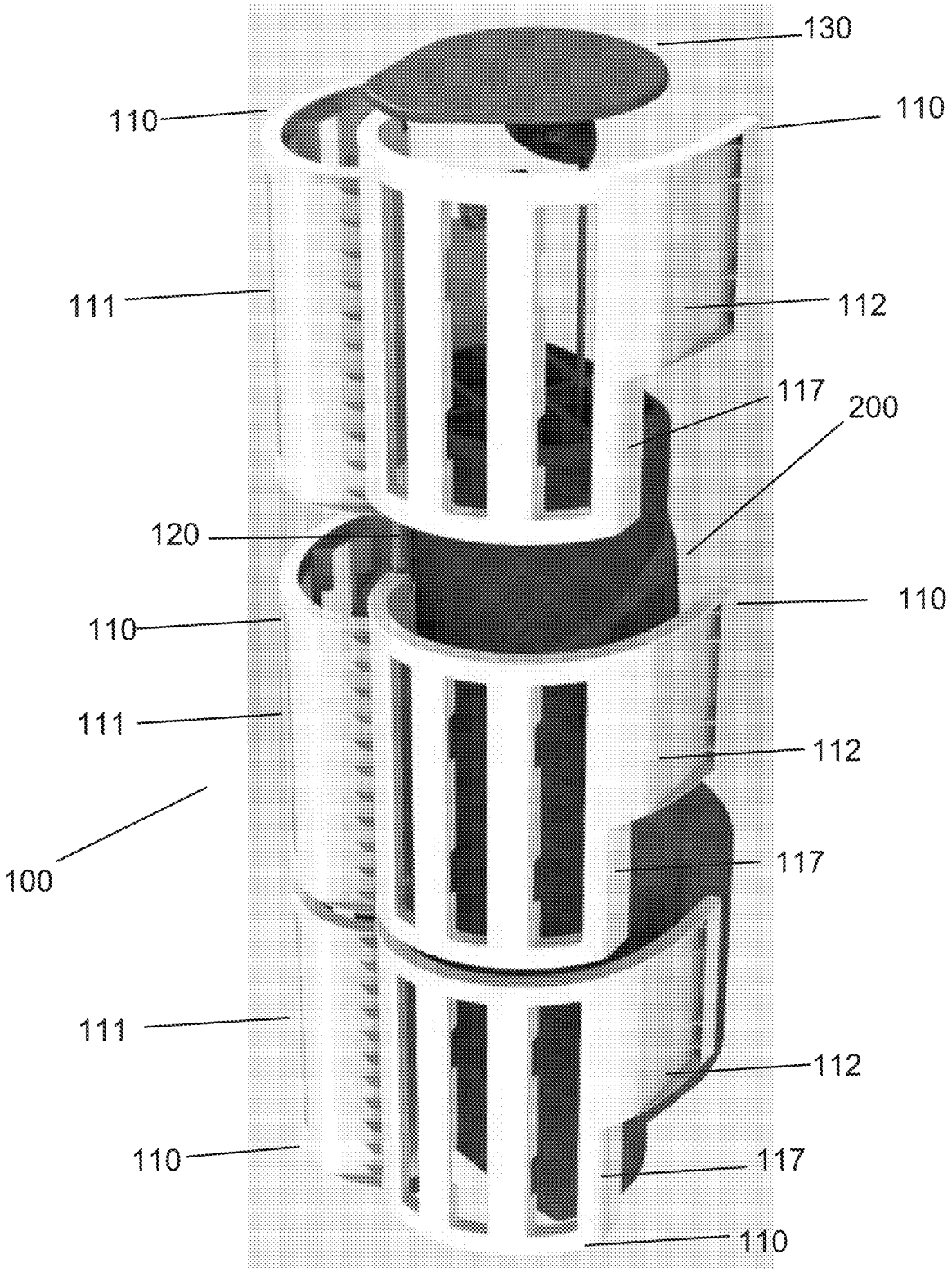
FIG. 2B shows a second view of the apparatus used in combination with a golf bag according to an embodiment of the present invention.

The present invention will now be described with reference made to FIGS. 1A-11C.

In accordance with the present invention, an apparatus 100 is provided in the form of a protective case or frame for protecting equipment during travel. In the embodiment of the invention illustrated in the Figures, the apparatus 100 is configured to protect golf clubs 210 in a golf bag 200 from damage by providing a protective structure encasing the golf bag 200, including around the shafts of the golf clubs 210 in the golf bag 200. However, the apparatus 100 of the present invention is not limited to such use, and can be configured or utilized to protect other equipment or objects, including but not limited to tennis equipment, fishing equipment such as fishing rods, and skiing equipment, or industrial products.

The apparatus 100 is provided with a modular construction in which the components can be easily assembled and disassembled to provide easy transport and storage of the apparatus 100, and in which the apparatus 100 can be configured into various sizes to allow flexibility in usage.

As shown for example in the embodiment shown in FIGS. 1A-5D, the apparatus 100 comprises a plurality of frame members 110 arranged on a central spine 120. In a preferred embodiment of the invention, the plurality of frame members 110 each have the same structural configuration and same dimensions, and are stacked on the central spine 120 in an alternating arrangement to provide a protective case 100 having pairs of opposing frame members 110 that can be closed around the golf bag 200 by pushing the opposing frame members 110 inward toward each other. The frame members 110 are configured to pivot around the central spine 120. The opposing frame members 110 can be attached to each other around the golf bag 200 to secure and encase the golf bag 200 within the apparatus 100. In the embodiment of the apparatus 100 shown in FIGS. 1A-5D, the apparatus 100 comprises six frame members 110 forming three pairs of opposing frame members 110. However, the number of frame members 110 comprised by the apparatus 100 may vary in alternative embodiments. The apparatus 100 also comprises a cover 130 arranged atop the frame members 110 to cover the top of the golf bag 200 and prevent the golf clubs 210 from being dislodged vertically out of the apparatus 100 and to protect the golf clubs 210 from downward forces.

Figure 3:
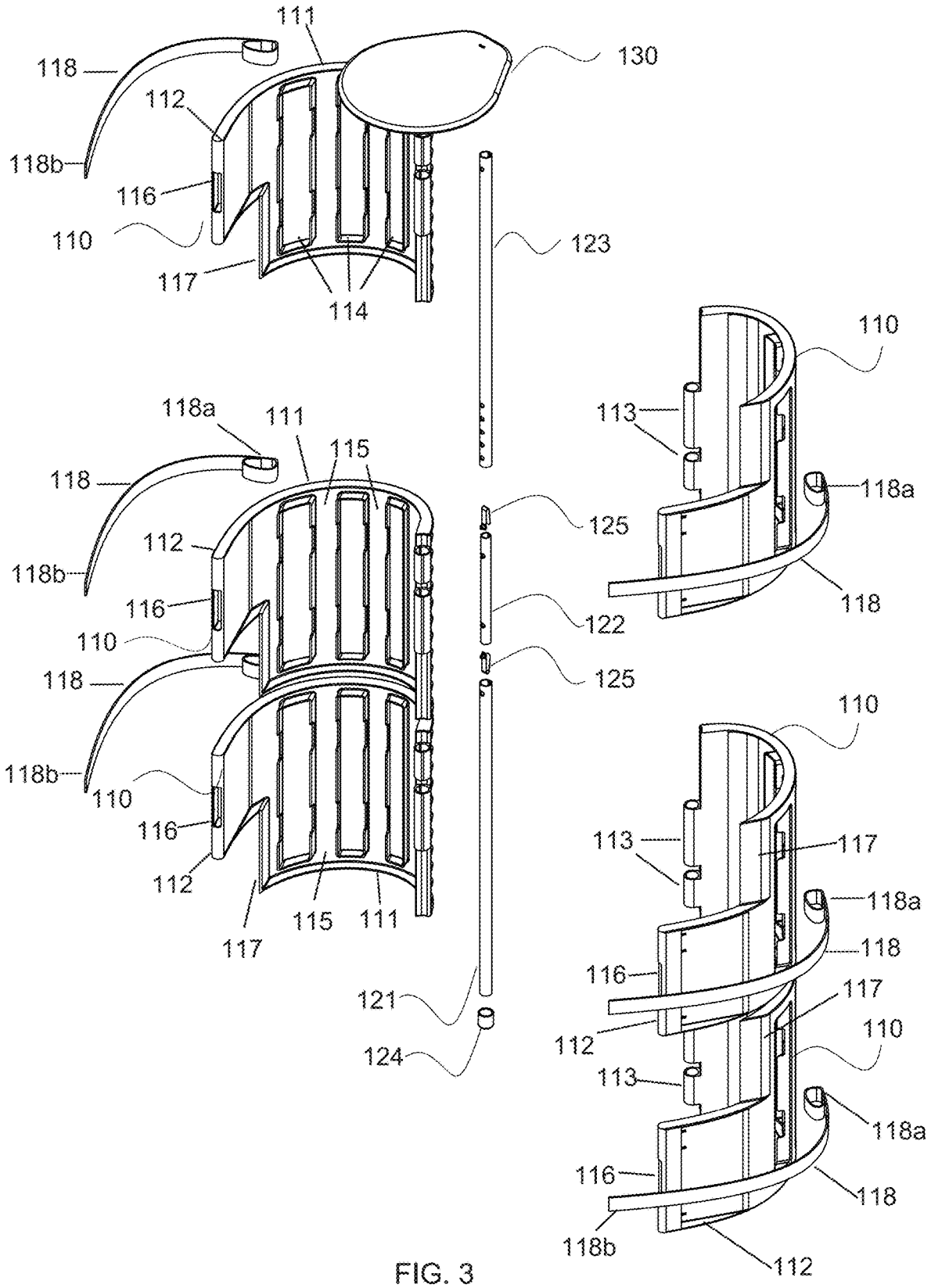
FIG. 3 shows an exploded view of an apparatus according to an embodiment of the present invention.

FIG. 3 provides an exploded view of the apparatus 100 illustrating each of the components of the apparatus, including the frame members 110, central spine 120 and cover 130.

The plurality of frame members 110 provide the protective structure or frame of the apparatus 100 that is formed around the golf bag 200. As shown in FIGS. 6A-6D, each of the frame members 110 comprises a frame body section 111 providing most of the structure of the frame member 110. A frame arm 112 extends from a portion of a first end 117 of the frame body section 111. The opposing, second end of the frame body section 111 comprises one or more spine receiving members 113, configured to attach the frame member 110 to the central spine 120. In a preferred embodiment, the spine receiving members 113 may include one or more hollow tubes that are dimensioned to slide over and receive the central spine 120. In other embodiments of the invention, the spine receiving members 113 may include hooks or clasps that are configured to clamp around the central spine 120 or ties, buckles or straps that may be wrapped and affixed around the central spine 120.

The frame body section 111 may include a plurality of support bars 115 with open portions 114 formed therebetween. In the embodiment shown in the Figures, the frame body section 111 comprises two support bars 115 defining three open portions 114, but other embodiments of the invention may include more or less support bars 115 and open portions 114. In further embodiments, the frame body section 111 may be solid and have no open portions 114. In the embodiments of the frame member 110 illustrated in the Figures, the frame member 110 has a curved shape, as shown for example in FIG. 6A. However, the frame member 110 may take other shapes in alternative embodiments of the invention. For example, the frame member 110 may have a semi-circular profile or may include two or more flat sections that are bent at particular angles, so as to provide a profile that is triangular, square, rectangular, semi-hexagonal, and so forth.

To assemble the apparatus 100, a first frame member 110 is attached to the central spine 120 by inserting the central spine 120 through the spine receiving members 113 of the frame member 110. In a preferred arrangement of the apparatus 100, the first frame member 110 is attached to the central spine 120 with the frame arm 112 arranged on the bottom of the frame member 110, so that the frame arm 112 would be arranged at the lowest part of the apparatus 100 (relative to the orientation of the apparatus 100 as shown in FIG. 1A for example). A second frame member 110 is then attached to the central spine 120 in the same manner, except that the orientation of the second frame member 110 is reversed, so that the frame arm 112 is arranged at the top of the second frame member 110. With this arrangement, the first and second frame members 110 create an opening between them, as shown for example in FIG. 1B, that can be closed, as shown for example in FIG. 1A, by pushing the frame members 110 inwardly towards each other, as they pivot around the central spine 120. When the first and second frame members 110 are pushed together the frame arm 112 of the first frame member 110 is arranged beneath the frame arm 112 of the second frame member 110, the frame arm 112 of the first frame member 110 is arranged across from the first end 117 of the frame body 111 of the second frame member 110, and the frame arm 112 of the second frame member 110 is arranged across from the first end 117 of the frame body section 111 of the first frame member 110.

Each of the frame members 110 comprises a locking member 118 configured to secure one frame member 110 to an opposing frame member 110 to close the apparatus 100. In a preferred embodiment shown for example in FIGS. 1A-1B and 3, the locking member 118 comprises a strap 118 that connects two frame members 110. The strap 118 comprises a first end 118*a* and a second end 118*b*. Each side of the strap 118, at least at the ends 118*a*, 118*b* are provided with corresponding parts of a hook-and-loop fastener on the surface, such that the ends 118*a*, 118*b* can be folded over and form a closed loop, secured by the hook-and-loop fastener. The first end 118*a* of the strap 118 is secured to a bar 115 of a first frame member 110, by wrapping the first end 118*a* of the strap 118 around the bar 115 and securing the strap 118 with the hook-and-loop fastener. The second end 118*b* passes through an opening 116 in the frame arm 112 of the same frame member 110, and can be wrapped around a bar 115 on an opposing frame member 110 and secured by the hook-and-loop fasteners. The second end 118*b* can be secured to different bars 115 on the frame members 110 depending on the size of the object being enclosed by the pair of the frame members 110. For example, the golf bag 200 may have a greater diameter at the bottom of the golf bag 200 than at the top, in which case the straps 118 at the bottom of the apparatus 100 may be arranged in one configuration to accommodate a larger size and the straps 118 at the top of the apparatus 100 may in arranged in a second configuration to accommodate a smaller size. Alternative connecting mechanisms can be utilized other than corresponding hook-and-loop fasteners, including corresponding ends of a snap fit or button engagement, corresponding engaging magnetic elements, corresponding parts of a buckle arrangement or strings or rope configured to be tied around the bars 115 of the frame members 110.

In alternative embodiments, each of the frame members 110 may comprise separate locking means configured to engage each other to connect two frame members. For example, each frame member may comprise one locking means arranged on the frame arm 112, or in another location on the frame member 110, and another locking means arranged on the first end 117 of the frame body section 111 adjacent to the frame arm 112, or in another location on the frame member 110. The first locking means and the second locking means are configured to be counterparts in a locking arrangement, such that when a pair of two frame members 110 are assembled on the apparatus 100 as previously described, the first locking means of the first frame member 110 interacts with the second locking means of the second, adjacent frame member 110 and the second locking means of the first frame member 110 interacts with the first locking means of the second, adjacent frame member 110. For example, in one embodiment similar to the above-described embodiment, the locking member 118 may include two separate straps affixed to the frame member 110 comprising an end portion with corresponding hook-and-loop fasteners on each side, such that the two straps of one frame member 110 are configured to engage the two straps of the opposing frame member 110 in the middle of the apparatus 100. In alternative embodiments, the straps may operate in a similar manner but comprise corresponding ends of a snap fit or button engagement, corresponding engaging magnetic elements, corresponding parts of a buckle arrangement or strings or rope configured to be tied together. The straps may alternatively take the form of one or more strings or ropes configured to be tied securely after inserting through the opening.

In the embodiments shown in the Figures, each of the plurality of frame members 110 have the same structure and same dimensions. As a result, the apparatus 100 can be more easily assembled because the frame members 110 can be attached to the central spine 120 in any order, as they are each substantially identical. For example, if six frame members 110 are being assembled into the apparatus 100, the user can pick up any of the six frame members 110 and attach the frame member 110 to the central spine 120 without being concerned about whether the frame members 110 are being assembled in the correct sequence. Additionally, if one of the plurality of frame members 110 were to be damaged and require replacement, it can be easily replaced without needing to replace or repair the entire apparatus 100.

The apparatus 100 also comprises a cover 130 configured to be attached to the central spine 120 atop the plurality of frame members 110. The cover 130 may take the form of a substantially flat disk, or one or both surfaces of the cover 130 may have a ribbed arrangement to provide further structural rigidity to the cover 130. The cover 130 comprises a connecting member 131 to attach the cover 130 to the central spine 120. In certain embodiments, the connecting member 131 is configured to be inserted into the top of the central spine 120 and securely fit therein. The connecting member 131 may comprise a button that can be pushed inward when the connecting member 131 is inserted into the central spine 120 and extend outward once the button overlaps with an opening 123*a* in the central spine 120 dimensioned to receive the button and secure the cover 130 to the central spine 120 in a manner that also enables the cover 130 to be removed by pushing the button inward. In alternative embodiments, the connecting member 131 and top of the central spine 120 may be threaded. A bottom cover may also be provided in further embodiments of the apparatus 100.

As shown in FIG. 3 and FIGS. 8A-11C, the central spine 120 of the apparatus 100 may include multiple segments to provide the apparatus 100 with adjustable lengths, and to provide a central spine 120 that can be stored more easily by separating it into shorter spine elements. The central spine 120 may include a lower spine member 121, an intermediate spine member 122 and an upper spine member 123.

The lower spine member 121, shown for example in FIGS. 8A-8D, is arranged at the bottom of the central spine 120 and comprises a cap 124 secured to the base. The lower spine member 121 may be inserted into the cap 124 or the cap 124 may be inserted into the base of the lower spine member 121. However, it is preferable that the cap 124 at its widest have a diameter greater than the lower spine member 121 and the spine receiving members 113 of the frame members 110, to prevent the frame members 110 from sliding off of the lower spine member 121.

An intermediate spine member 122 may be provided that connects the lower spine member 121 and upper spine member 123, as shown in FIGS. 10A-10D. The intermediate spine member 122 preferably has an outer diameter that is less than the inner diameters of each of the lower spine member 121 and upper spine member 123, so that it can fit within both of the lower and upper spine members 121, 123. In the embodiment of the apparatus 100 shown in FIG. 3, the intermediate spine member 122 is provided with an adapter 125 on each end. The adapters 125 are affixed inside each end of the intermediate spine member 122 and comprise a retractable button that is configured to pass through openings 122*a*, 122*b* on each end of the intermediate spine member 122. The lower end of the intermediate spine member 122 can be inserted into the upper end of the lower spine member 121 and the intermediate spine member 122 connected to the lower spine member 121 by retracting the button in opening 122*b* until it passes through the opening 121*a* in the lower spine member 121. The upper end of the intermediate spine member 122 can be inserted into the lower end of the upper spine member 123 and the intermediate spine member 122 connected to the upper spine member 121 by retracting the button in opening 122*a* until it passes through an opening 123*b* in the upper spine member 121.

As shown in FIGS. 9A-9D, the upper spine member 123 may include a plurality of openings 123*b* at the lower portion of the upper spine member 123. This enables the overall length of the central spine 120 to be adjustable, as the button of the adapter 125 can be retracted until it passes through one of the openings 123*b*, and the length of the central spine 120 dependent upon which opening 123*b* is used (i.e., if the adapter 125 passes through the bottom opening 123*b*, the central spine will have a greater length than if the adapter passes through the top opening 123*b*).

In another embodiment of the invention, the intermediate spine member 122 may omit the openings 122*a*, 122*b* and the adapters 125 and be threaded, and the lower and upper spine members 121, 123 may also be threaded, so that the spine members 121, 122, 123 are connected via a threaded engagement.

In alternative embodiments, the central spine 120 may omit the intermediate spine member 122 and the lower and upper spine members 121, 123 may be directly connected. For example, the lower spine member 121 may have a smaller diameter than the upper spine member 123 and comprise a button as provided on the adapter 125 in place of the opening 121*a* that is configured to be inserted through one of the openings 123*b* to attach the lower spine member 121 to the upper spine member 123. In another embodiment, this arrangement may be reversed, wherein the button is provided on the upper spine member 123 to be inserted through an opening 121*a* in the lower spine member 123. In a still further embodiment, the lower and upper spine members 121, 123 may comprise corresponding threaded sections.

In further alternative embodiments of the invention, the central spine 120 may include two or more upper spine members 123. For example, if the apparatus 100 is to be used in connection with skiing equipment, or other equipment longer than golf clubs 210, a second upper spine member 123 may be connected to the first upper spine member 123 by way of a second intermediate spine member 122, in the same manner that the lower and upper spine members 121, 123 are connected as described previously. Further upper spine members 123 and intermediate spine members 122 can be provided until the apparatus 100 is at a necessary length, wherein each of the intermediate and upper spine members 122, 123 can have the same configuration as shown and described herein to avoid a need for multiple, differently configured spine parts.

An exemplary process for assembling and using the apparatus 100 is as follows. The central spine 120 can be first assembled by connecting the lower spine member 121 and upper spine member 123 via the intermediate spine member 122. Preferably, the cap 124 is affixed to the end of the lower spine member 121 before the frame members 110 are attached so that the frame members 110 do not slide off of the central spine 120 during assembly. The frame members 110 can then be attached to the central spine 120. In the embodiment of the apparatus 100 shown in FIGS. 1A-5D, six frame members 110 are provided, but the number of frame members 110 may vary in other embodiments. Preferably however, an even number of frame members 110 is utilized so that each frame member 110 is provided as one in a pair of interlocking frame members 110. As previously described, a first frame member 110 is attached to the central spine 120 so that the frame arm 112 is arranged on the bottom of the apparatus 100 (relative to the orientation of the apparatus 100 shown in the Figures). The frame member 110 is attached to the central spine 120 by the spine receiving members 113, which may be one or more hollow tubular members. In this embodiment of the frame member 110, the spine receiving members 113 are arranged on an end of the frame body section 111 opposite and across from the frame arm 112, rather than along the entire length of the frame body section 111. After the first frame member 110 has been slid onto the central spine 120, a second frame member 110 can be slid onto the central spine 120 in the opposite orientation of the first frame member 110, that being with the frame arm 112 arranged on the top of the frame member 110 (relative to the orientation of the apparatus 100 shown in the Figures). The remaining four frame members 110 can be slid onto the central spine 120 in the same manner with alternating orientations. Once all of the six frame members 110 have been connected to the central spine 120, the golf bag 200 or other equipment can be placed onto the apparatus 100. Depending on the size of the equipment that is being encased in the apparatus 100, the length of the central spine 120 can be adjusted before or after assembly of the apparatus 100 to the appropriate length. Additionally, the cover 130 can be attached to the central spine 120 before or after inserting the equipment into the apparatus 100. After the golf bag 200 or equipment is inserted into the apparatus 100, the frame members 110 can be locked together to enclose the golf bag 200 or equipment. Each of the six frame members 110 includes a locking member 118 configured to secure the frame member 110 to an opposing frame member 110. Thus, the locking member 118 of the first frame member 110 engages the first frame member 110 to the second frame member 110 and the locking member 118 of the second frame member 110 further engages the second frame member 110 to the first frame member 110. This locking arrangement continues for each pair of the frame members 110 (i.e., the third and fourth frame members 110 and the fifth and sixth frame members 110). When each of the pairs of frame members 110 are locked together, the golf bag 200 or other equipment is securely enclosed in the apparatus 100. Preferably, for transportation of the apparatus 100 containing the golf bag 200 or other equipment, the apparatus 100 and its enclosed golf bag 200 or other equipment are then placed in a larger travel bag.

When use of the apparatus 100 is no longer required, the apparatus 100 can be opened to remove the golf bag 200 or other equipment, and disassembled by reversing the process previously described.

In an embodiment of the invention, a kit can be provided including one or more of the above-referenced components to assemble the apparatus 100, including a bag or case for storing the components of the apparatus 100 when the apparatus is not in use.

The apparatus 100 and its components can be made from any number of suitable materials without departing from the scope of the invention. For example, the frame members 110, central spine 120 and cover 130 can be made from any number of metallic materials or plastic or other synthetic materials. In one embodiment of the apparatus 100, the frame members 110 are made from high-density polyethylene (HDPE), the lower, intermediate and upper spine members 121, 122, 123 are made from aluminum, the cap 124 is made from a rubber material, and the cover 130 is made from a nylon material.

The dimensions of the apparatus 100 and its components can also vary without departing from the overall scope of the invention. For the embodiments illustrated in the Figures configured for use as a protective case or frame for a golf bag 200, various approximate exemplary dimensions are provided.

Figure 4A:
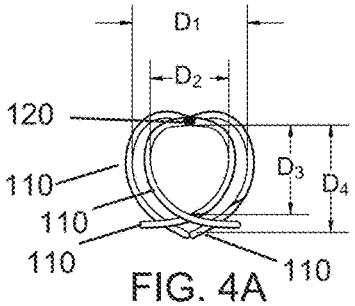
FIGS. 4A-4C show various views of the apparatus according to an embodiment of the present invention.
Figure 4B:
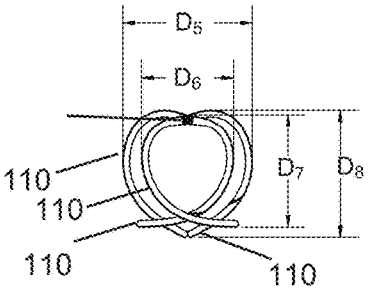
Figure 4C:
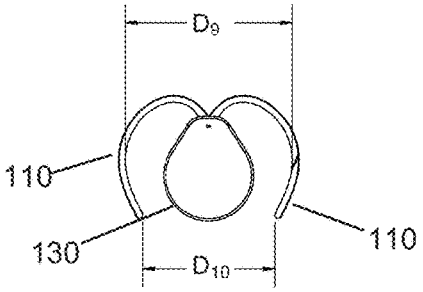

For example, as illustrated in FIGS. 4A-4C, an embodiment of the apparatus 100, in various opened and closed configurations may have the approximate dimensions $D_1$ (12.8 inches), $D_2$ (8.7 inches), $D_3$ (9.9 inches), $D_4$ (11.9 inches), $D_5$ (14.3 inches), $D_6$ (10.2 inches), $D_7$ (12.5 inches), $D_8$ (14.1 inches), $D_9$ (18.5 inches), and $D_{10}$ (14.6 inches).

Figure 5A:
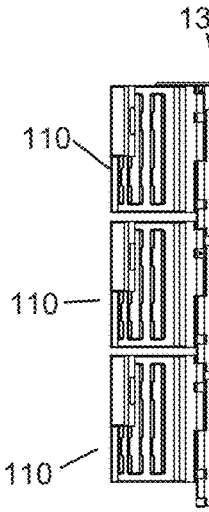
FIGS. 5A-5D show various views of the apparatus according to an embodiment of the present invention.
Figure 5B:
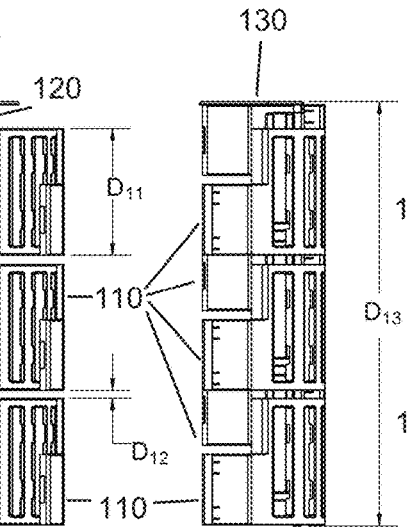
Figure 5C:
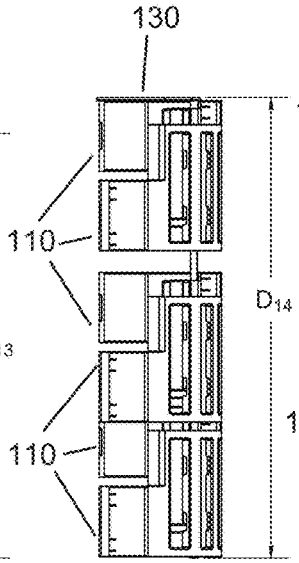
Figure 5D:
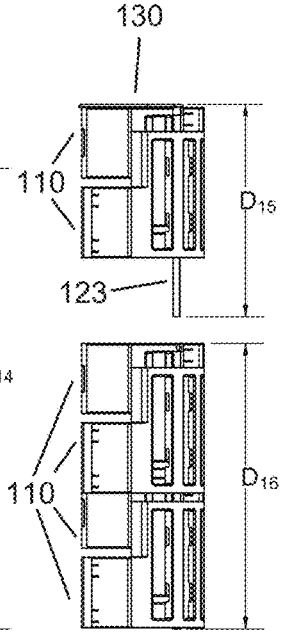
Figure 6A:
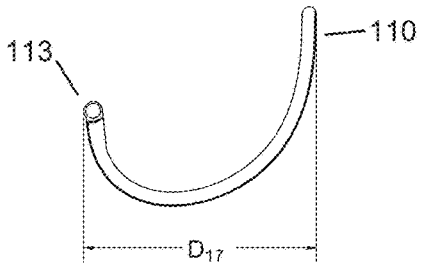
FIGS. 6A-6D show various views of a frame member of the apparatus according to an embodiment of the present invention.
Figure 6B:
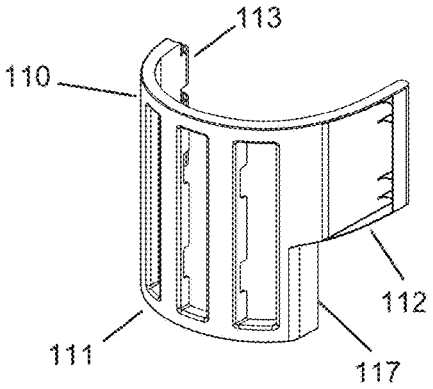
Figure 6C:
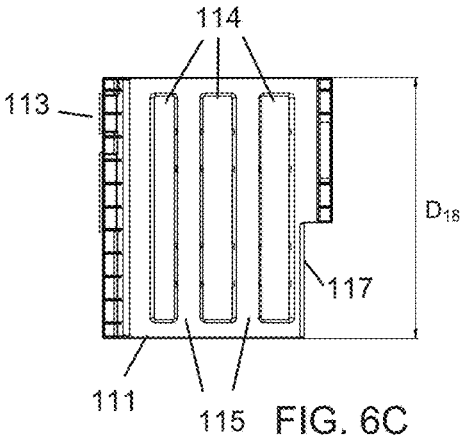
Figure 6D:
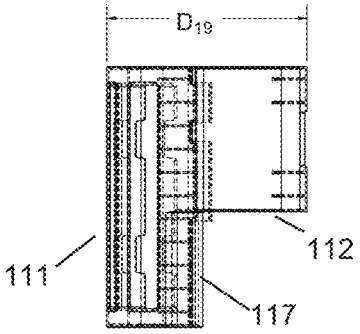
Figure 7A:
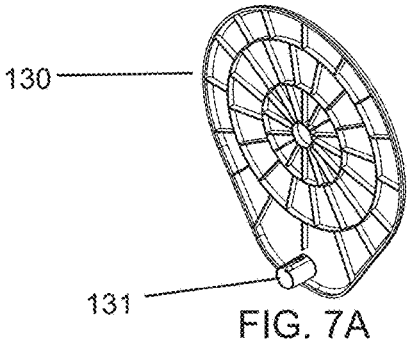
FIGS. 7A-7D show various views of the cover of the apparatus according to an embodiment of the present invention.
Figure 7B:
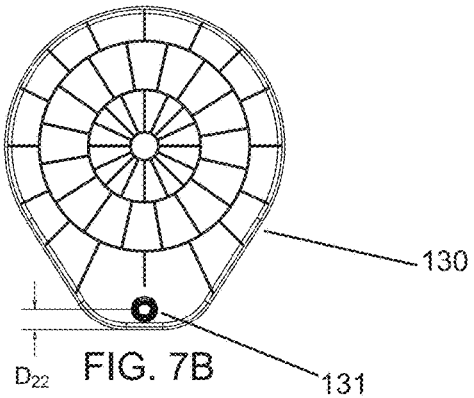
Figure 7C:
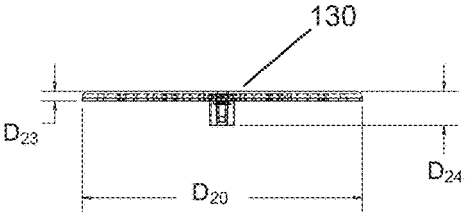
Figure 7D:
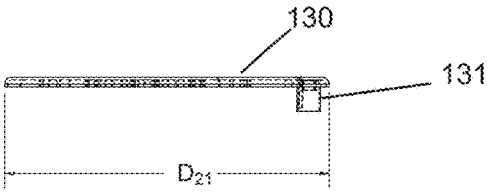

As illustrated in FIGS. 5A-5C, an embodiment of the apparatus 100, in various stages of assembly may have the approximate dimensions $D_{11}$ (14.0 inches), $D_{12}$ (0.9 inches), $D_{13}$ (47.0 inches), $D_{14}$ (51.0 inches), $D_{15}$ (23.5 inches), and $D_{16}$ (31.6 inches).

As illustrated in FIGS. 6A-6D, an embodiment of the frame member(s) 110 of the apparatus 100, may have the approximate dimensions $D_{17}$ (12.5 inches), $D_{18}$ (14.0 inches) and $D_{19}$ (10.7 inches).

As illustrated in FIGS. 7A-7D, an embodiment of the cover 130 of the apparatus 100 may have the approximate dimensions $D_{20}$ (10.0 inches), $D_{21}$ (11.574 inches), $D_{22}$ (0.75 inches), $D_{23}$ (0.35 inches) and $D_{24}$ (1.225 inches).

As illustrated in FIGS. 8A-8D, an embodiment of the lower spine member 121 of the apparatus 100 may have the approximate dimensions $D_{25}$ (23.4 inches) and $D_{26}$ (0.625 inches). The thickness of the wall of the lower spine member 121 may be approximately 0.058 inches. The lower spine member 121 may have an outer diameter of approximately 0.75 inches. The diameter of the opening 121*a* of the lower spine member 121 may be approximately 0.27 inches.

As illustrated in FIGS. 9A-9D, an embodiment of the upper spine member 123 of the apparatus 100 may have the approximate dimensions $D_{27}$ (23.4 inches), $D_{28}$ (0.915 inches), $D_{29}$ (0.625 inches) and $D_{30}$ (1.0 inch). The thickness of the wall of the upper spine member 123 may be approximately 0.058 inches. The upper spine member 123 may have an outer diameter of approximately 0.75 inches. The diameter of the openings 123*a*, 123*b* of the upper spine member 123 may be approximately 0.27 inches.

As illustrated in FIGS. 10A-10D, an embodiment of the intermediate spine member 122 of the apparatus 100 may have the approximate dimensions $D_{31}$ (8.0 inches), $D_{32}$ (1.375 inches) and $D_{33}$ (1.375 inches). The thickness of the wall of the intermediate spine member 122 may be approximately 0.063 inches. The upper spine member 122 may have an outer diameter of approximately 0.625 inches. The diameter of the openings 122*a*, 122*b* of the intermediate spine member 122 may be approximately 0.27 inches.

As illustrated in FIGS. 11A-11C, an embodiment of the cap 124 of the apparatus 100 may have the approximate dimensions $D_{34}$ (0.995 inches) and $D_{35}$ (0.759 inches). The cap 124 may have a greatest outer diameter of approximately 0.944 inches.

Alternative embodiments of the invention may be provided in which the dimensions deviate from those indicated above without departing from the scope of the invention.

As used herein, directional or positional terms such as "upper", "lower", "top", "bottom", etc., are used for explanatory purposes only to describe the apparatus 100 having the orientation shown on the page for example in FIGS. 1A-3.

While there have been shown and described and pointed out fundamental novel features of the invention as applied to preferred embodiments thereof, it will be understood that various omissions and substitutions and changes in the form and details of the devices and methods described may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice.

What is claimed:

1. An apparatus for enclosing and protecting an article, comprising:

a central spine; and a plurality of frame members connected to the central spine, the plurality of frame members comprising at least one pair of frame members comprising:

a first frame member comprising a first locking member, and arranged on the central spine in a first orientation; and a second frame member comprising a second locking member, and arranged on the central spine in a second orientation;

wherein the first locking member of the first frame member is configured to be attached to the second frame member and the second locking member of the second frame member is configured to be attached to the first frame member, such that the first frame member is configured to engage the second frame member around the article to enclose the article between the first frame member and the second frame member.

2. The apparatus according to claim 1, wherein each of the plurality of frame members comprises:

a frame body section, a frame arm extending from a first side of the frame body section, and at least one spine receiving member arranged on a second side of the frame body section opposite the first side and configured to attach the frame member to the central spine.

3. The apparatus according to claim 2, wherein the frame body section of each of the plurality of frame members further comprises one or more bars and a plurality of open spaces formed between the one or more bars.

4. The apparatus according to claim 1, wherein the plurality of frame members comprises at least two pairs of frame members, including:

a first pair of frame members comprising:

the first frame member comprising the first locking member, and the second frame member comprising the second locking member; and a second pair of frame members arranged on the central spine adjacent to the first pair of frame members, comprising:

a third frame member arranged on the central spine in the first orientation and comprising a third locking member, and a fourth frame member arranged on the central spine in the second orientation comprising a fourth locking member, wherein the third locking member of the third frame member is configured to be attached to the fourth frame member and the fourth locking member of the fourth frame member is configured to be attached to the third frame member, such that the third frame member is configured to engage the fourth frame member around the article.

5. The apparatus according to claim 4, further comprising a third pair of frame members arranged on the central spine adjacent to the second pair of frame members, comprising:

a fifth frame member arranged on the central spine in the first orientation and comprising a fifth locking member, and a sixth frame member arranged on the central spine in the second orientation comprising a sixth locking member, wherein the fifth locking member of the fifth frame member is configured to be attached to the sixth frame member and the sixth locking member of the sixth frame member is configured to be attached to the fifth frame member, such that the fifth frame member is configured to engage the sixth frame member around the article.

6. The apparatus according to claim 1, wherein each of the plurality of frame members are structurally and dimensionally the same.

7. The apparatus according to claim 1, wherein the central spine comprises a plurality of spine members, including a first spine member and a second spine member configured to be connected to the first spine member.

8. The apparatus according to claim 7, wherein the central spine further comprises an intermediate spine member configured to connect the first spine member to the second spine member.

9. The apparatus according to claim 1, wherein the central spine comprises an adjustable length.

10. The apparatus according to claim 1, further comprising a cover connected to a first end of the central spine configured to prevent the article from sliding out an open end of an enclosure formed by the plurality of frame members and configured to prevent the plurality of frame members from sliding off of the first end of the central spine.

11. The apparatus according to claim 10, further comprising a cap connected to a second end of the central spine opposite the first end and configured to prevent the plurality of frame members from sliding off of the second end of the central spine.

12. The apparatus according to claim 2, wherein the at least one spine receiving member comprises at least one hollow tube configured to receive the central spine to attach the frame member to the central spine.

13. The apparatus according to claim 1, wherein the article is a golf bag comprising golf clubs.

14. An apparatus for enclosing and protecting an article, comprising:

a central spine; and a plurality of frame members connected to the central spine, the plurality of frame members comprising at least one pair of frame members comprising:

a first frame member comprising a first locking member, and arranged on the central spine in a first orientation; and a second frame member comprising a second locking member, and arranged on the central spine in a second orientation;

wherein the first locking member of the first frame member is configured to be attached to the second frame member and the second locking member of the second frame member is configured to be attached to the first frame member, such that the first frame member is configured to engage the second frame member around the article, wherein each of the plurality of frame members comprises:

a frame body section, a frame arm extending from a first side of the frame body section, and at least one spine receiving member arranged on a second side of the frame body section opposite the first side and configured to attach the frame member to the central spine, wherein the frame body section of each of the plurality of frame members further comprises one or more bars and a plurality of open spaces formed between the one or more bars;

wherein the first locking member comprises a strap having a first end with corresponding hook-and-loop fasteners on opposing sides of the strap to engage the first end of the strap to one of the one or more bars of the first frame member and a second end configured to pass through an opening in the frame arm section of the first frame member and comprising corresponding hook-and-loop fasteners on opposing sides of the strap to engage the second end of the strap to one of the one or more bars of the second frame member; and wherein the second locking member comprises a strap having a first end with corresponding hook-and-loop fasteners on opposing sides of the strap to engage the first end of the strap to one of the one or more bars of the second frame member and a second end configured to pass through an opening in the frame arm section of the second frame member and comprising corresponding hook-and-loop fasteners on opposing sides of the strap to engage the second end of the strap to one of the one or more bars of the first frame member.

15. A kit for an apparatus for enclosing and protecting an article, comprising:

a central spine;

a plurality of frame members, each comprising:

a frame body section, a frame arm extending from a first side of the frame body section, and at least one spine receiving member arranged on a second side of the frame body section opposite the first side and configured to removably attach the frame member to the central spine configured to be connected to the central spine, and a plurality of locking members, including a locking member for each of the plurality of frame members, configured to secure one of the plurality of frame members to another of the plurality of frame members when arranged on the central spine to enclose the article between the plurality of frame members.

16. The kit according to claim 15, wherein the frame body section of each of the plurality of frame members further comprises one or more bars and a plurality of open spaces formed between the one or more bars.

17. The kit according to claim 16, wherein each of the plurality of locking members comprises a strap having a first end with corresponding hook-and-loop fasteners on opposing sides of the strap to engage the first end of the strap to one of the one or more bars of a first frame member and a second end configured to pass through an opening in the frame arm section of the first frame member and comprising corresponding hook-and-loop fasteners on opposing sides of the strap to engage the second end of the strap to one of the one or more bars of a second frame member.

18. The kit according to claim 15, wherein the central spine comprises a plurality of spine members, including a first spine member and a second spine member configured to be connected to the first spine member.

19. The kit according to claim 18, wherein the central spine further comprises an intermediate spine member configured to connect the first spine member to the second spine member.

20. The kit according to claim 15, further comprising:

a cover configured to be connected to a first end of the central spine; and a cap configured to be connected to a second end of the central spine opposite the first end and configured to prevent the plurality of frame members from sliding off of the second end of the central spine.

* * * * *